US011002021B2

(12) United States Patent
Cappelle et al.

(10) Patent No.: US 11,002,021 B2
(45) Date of Patent: May 11, 2021

(54) SET OF FLOOR PANELS FOR FORMING A FLOOR COVERING

(71) Applicant: FLOORING INDUSTRIES LIMITED, SARL, Bertrange (LU)

(72) Inventors: Mark Cappelle, Staden (BE); Pieter Devos, Koolskamp (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 15/769,127

(22) PCT Filed: Oct. 20, 2016

(86) PCT No.: PCT/IB2016/056309

§ 371 (c)(1),
(2) Date: Apr. 18, 2018

(87) PCT Pub. No.: WO2017/068523

PCT Pub. Date: Apr. 27, 2017

(65) Prior Publication Data

US 2018/0305937 A1 Oct. 25, 2018

(30) Foreign Application Priority Data

Oct. 23, 2015 (BE) ..... 2015/5686

(51) Int. Cl.
*E04F 15/02* (2006.01)
*E04F 15/04* (2006.01)
*E04F 15/10* (2006.01)

(52) U.S. Cl.
CPC ..... *E04F 15/02038* (2013.01); *E04F 15/02* (2013.01); *E04F 15/04* (2013.01);
(Continued)

(58) Field of Classification Search
CPC ..... E04F 15/02038; E04F 15/02; E04F 2201/023; E04F 2201/0146; E04F 15/10;
(Continued)

(56) References Cited

U.S. PATENT DOCUMENTS 6,006,486 A * 12/1999 Moriau ..... B27F 1/06 52/589.1
7,624,552 B2 * 12/2009 Thiers ..... E04F 15/02 52/403.1

(Continued)

FOREIGN PATENT DOCUMENTS

CA 2522130 A1 * 12/1997 ..... B27F 1/06
CA 2569614 C * 3/2010 ..... B27F 1/06

(Continued)

OTHER PUBLICATIONS

Belgian Search Report from BE Application No. BE 201505686, dated Jun. 16, 2016.

(Continued)

*Primary Examiner* — Brent W Herring
(74) *Attorney, Agent, or Firm* — Workman Nydegger

(57) ABSTRACT

A set of floor panels for forming a floor covering, which comprises at least two floor panels, which each comprise an edge provided with a coupling part, wherein the coupling parts are configured such that they allow realizing a coupled condition between the floor panels, by means of a substantially straight-lined coupling movement of the one floor panel in respect to the other floor panel, according to a direction substantially perpendicular to an installation plane; and wherein the coupling parts are configured such that they, in the coupled condition, realize a tensioning force pressing the coupled edges towards each other.

18 Claims, 4 Drawing Sheets

(52) U.S. Cl.
CPC ..... *E04F 15/10* (2013.01); *E04F 2201/0146* (2013.01); *E04F 2201/0153* (2013.01); *E04F 2201/0161* (2013.01); *E04F 2201/023* (2013.01); *E04F 2201/03* (2013.01); *E04F 2201/043* (2013.01); *E04F 2201/0535* (2013.01)

(58) Field of Classification Search
CPC ..... E04F 2201/043; E04F 2201/0535; E04F 15/04; E04F 2201/03; E04F 2201/0161; E04F 2201/0153
See application file for complete search history.

(56) References Cited

U.S. PATENT DOCUMENTS 8,024,904 B2 * 9/2011 Hannig ..... E04F 15/02038 52/586.1
8,220,217 B2 * 7/2012 Muehlebach ..... E04F 15/02 403/320
8,381,476 B2 2/2013 Hannig
8,544,231 B2 10/2013 Hannig
8,615,953 B2 * 12/2013 Cappelle ..... E04F 15/02038 52/588.1
8,627,862 B2 1/2014 Pervan et al.
8,720,150 B2 5/2014 Hannig
8,991,055 B2 3/2015 Cappelle
9,145,691 B2 9/2015 Cappelle
9,175,475 B2 11/2015 Hannig
9,200,460 B2 12/2015 Cappelle
9,290,948 B2 3/2016 Cappelle et al.
9,340,974 B2 5/2016 Pervan et al.
9,366,037 B2 6/2016 Cappelle
9,487,957 B2 11/2016 Cappelle
9,556,620 B2 * 1/2017 Cappelle ..... E04F 15/10
9,695,599 B2 7/2017 Cappelle
9,695,851 B2 7/2017 Hannig
9,890,542 B2 2/2018 Cappelle
9,932,741 B2 4/2018 Cappelle et al.
10,006,210 B2 6/2018 Pervan et al.
10,017,948 B2 * 7/2018 Boo ..... E04C 2/40
10,113,318 B2 * 10/2018 Cappelle ..... B65D 85/62
10,352,049 B2 * 7/2019 Boo ..... E04F 15/102
2004/0035079 A1 2/2004 Evjen
2006/0064940 A1 * 3/2006 Cappelle ..... A47G 27/0293 52/589.1
2007/0006543 A1 * 1/2007 Engstrom ..... E04F 15/02 52/582.1
2008/0236088 A1 * 10/2008 Hannig ..... F16B 5/0056 52/592.1
2009/0133353 A1 * 5/2009 Pervan ..... H01F 7/122 52/588.1
2009/0193741 A1 * 8/2009 Cappelle ..... E04F 15/02 52/309.1
2009/0320402 A1 * 12/2009 Schacht ..... E04F 15/02 52/588.1
2010/0043333 A1 2/2010 Hannig
2011/0030303 A1 2/2011 Pervan et al.
2011/0131909 A1 6/2011 Hannig
2011/0271632 A1 * 11/2011 Cappelle ..... E04F 15/02 52/582.2
2012/0096801 A1 * 4/2012 Cappelle ..... E04F 15/02038 52/592.1
2013/0276398 A1 10/2013 Hannig
2013/0309441 A1 11/2013 Hannig
2014/0007539 A1 * 1/2014 Pervan ..... H04M 1/0262 52/588.1
2014/0033636 A1 * 2/2014 Cappelle ..... E04F 15/02 52/592.1
2014/0090335 A1 4/2014 Pervan et al.
2014/0283477 A1 9/2014 Hannig
2015/0204080 A1 7/2015 Cappelle
2015/0204081 A1 7/2015 Cappelle
2015/0337540 A1 * 11/2015 Cappelle ..... E04F 15/02 52/309.1
2015/0337542 A1 * 11/2015 Cappelle ..... E04F 15/10 52/309.13
2016/0177577 A1 * 6/2016 Cappelle ..... B65B 11/004 52/588.1
2016/0215505 A1 7/2016 Cappelle et al.
2016/0251859 A1 9/2016 Pervan et al.
2016/0251861 A1 9/2016 Cappelle
2017/0051514 A1 2/2017 Cappelle
2017/0268545 A1 9/2017 Hannig
2017/0284106 A1 10/2017 Cappelle
2018/0127985 A1 5/2018 Cappelle
2019/0017278 A1 * 1/2019 De Rick ..... E04F 15/107
2019/0048595 A1 2/2019 Cappelle
2019/0127990 A1 5/2019 Pervan et al.
2020/0063443 A1 * 2/2020 Boucke ..... E04F 15/02038

FOREIGN PATENT DOCUMENTS

CA 2569612 C * 9/2010 ..... B27F 1/06
CN 101460688 A 6/2009
EP 2077358 A3 * 8/2009 ..... B27F 1/06
RU 2468166 C2 11/2012
RU 2485265 C2 6/2013
RU 2508431 C2 2/2014
WO 9747834 A1 12/1997
WO 0175247 A1 10/2001
WO 0196688 A1 12/2001
WO 2004059104 A1 7/2004
WO 2006043893 A1 4/2006
WO 2007141605 A2 12/2007
WO 2008068245 A1 6/2008
WO 2009066153 A2 5/2009
WO 2010015516 A2 2/2010
WO 2011028171 A1 3/2011
WO 2012084604 A1 6/2012
WO 2012101171 A1 8/2012
WO 2013102804 A2 7/2013

OTHER PUBLICATIONS

International Search Report from PCT Application No. PCT/IB2016/056309, dated Feb. 6, 2017.
Office Action from corresponding Russian Application No. 2018114633, dated Sep. 3, 2019.
Office Action from corresponding CN Application No. 2016800594613, dated Feb. 3, 2020.
Office Action from corresponding EP Application No. EP16798281.8, dated Dec. 17, 2020.

* cited by examiner

SET OF FLOOR PANELS FOR FORMING A FLOOR COVERING

BACKGROUND

1. Field of the Disclosure

The present invention relates to a set of floor panels, which is suitable for forming a floor covering.

More particularly, the present invention relates to a set of floor panels for forming a floor covering, of the type which comprises at least two floor panels, which each comprise an upper side, a lower side, and a core extending between the upper and lower sides, and which each comprise an edge provided with a coupling part, wherein the coupling parts are configured such that they allow realizing a coupled condition between the floor panels by means of a substantially straight coupling movement of the one floor panel in respect to the other floor panel, according to a direction substantially perpendicular to an installation plane; wherein the coupling parts in the coupled condition effect a locking in the direction parallel to the installation plane and perpendicular to the edges, as well as a locking in the direction perpendicular to the installation plane; wherein the coupling part of the one floor panel is made as a hook-shaped part directed towards the lower side of the floor panel, herein below denominated locking hook, and the coupling part of the other floor panel is made as a hook-shaped part directed towards the upper side of the floor panel, herein below denominated receiving hook; wherein the hook-shaped parts substantially are manufactured from the material of the core of the floor panels and substantially are made in one piece therewith; wherein the locking hook comprises a lip which is provided with a locking part extending towards the lower side of the floor panel, and the receiving hook comprises a lip which is provided with a locking part extending towards the upper side of the floor panel; and wherein the locking parts, in the coupled condition, cooperate in such a manner that they effect at least the aforementioned locking in the direction parallel to the installation plane and perpendicular to the edges.

2. Related Art

From, amongst others, documents WO 2010/015516 A2, WO 2011/028171 A1, WO 2012/084604 A1 and WO 2012/101171 A1, such sets of floor panels are known, wherein the locking in the direction perpendicular to the installation plane is effected without the assistance of a separate insertion piece or insert.

Documents WO 2006/043893 A1, WO 2008/068245 A1 and WO 2009/066153 A2 also form a disclosure of such sets of floor panels, wherein the locking in the direction perpendicular to the installation plane is effected by means of a separate insertion piece or insert.

A general problem with the known sets of floor panels as described above is the risk of moisture or dust penetrating between the coupled edges of the floor panels.

In order to remedy this problem, the already above-mentioned WO '153 describes that the floor panels described therein can be realized with a so-called "pretension", which means that the edges in the coupled condition are pressed towards each other by means of a tensioning force.

According to WO '153, the tensioning force can be realized in that the lip of the receiving hook, in the coupled condition, is elastically bent, wherein the principle known from WO 97/47834 A1 can be applied.

In that the coupled edges are pressed towards each other, the formation of gaps in the coupled condition is counteracted and thereby the risk of moisture or dust penetrating between the coupled edges is reduced.

However, there is a risk that difficulties will be experienced when coupling the floor panels which are provided with pretension. In order to be able to realize the pretension, the profile shapes or the contours of the coupling parts in fact have to be made overlapping, and thus they are not complementary fitting. Moreover, the coupling movement can be complicated further by the almost unavoidable tolerances of the perpendicularity of the sides of the floor panels.

Therefore, the coupling parts in practice mostly are configured such that they fit into each other with a certain play, which in its turn then entrains the risk of moisture and dust penetrating between the coupled edges. However, the play provides for that the floor panels can be coupled easily and that the tolerances of the perpendicularity of the sides of the floor panels can be compensated.

WO 2007/141605 (A2) as well describes that the floor panels described therein can be realized with a pretension, by means of an elastic bending of the lip of the receiving hook in the coupled condition, which provides for that the coupling parts are pressed towards each other. However, at least one of the hooks of WO '605 for the major part is made as a separate insertion piece, which is made of a different material than the core of the floor panel to which the respective hook is belonging. In that such insertion piece has to be provided, the floor panels of WO '605 are not cheap.

SUMMARY

The present invention primarily aims at an alternative set of floor panels for forming a floor covering, wherein according to various preferred embodiments solutions are offered to problems with the sets of floor panels of the state of the art.

To this aim, the invention, according to a first independent aspect thereof, relates to a set of floor panels for forming a floor covering, of the aforementioned type, with the characteristic that the coupling parts are configured such that they, in the coupled condition, realize a tensioning force pressing the coupled edges towards each other, by means of an elastic bending of the lip of the receiving hook; and that the lip of the receiving hook, in the coupled condition, in the direction perpendicular to the installation plane, shows a maximum bending of at most 0.0625 times the overall thickness of the floor panel.

The inventor has found that a maximum bending of at most 0.0625 times the overall thickness of the floor panel allows effectively counteracting the forming of gaps between the coupled edges and in this manner minimizing or even excluding the risk of penetrating moisture and dust. Therein, moreover it has become apparent that the floor panels, although they are provided with a pretension, still can be coupled to each other in a smooth manner.

A particularly good balance between the extent of gap counteracting and the smoothness of installation can be obtained when said maximum bending is at most 0.05 times the overall thickness of the floor panel and preferably is situated between 0.0065 and 0.025 times the overall thickness of the floor panel, wherein a value of approximately 0.0125 times the overall thickness of the floor panel has proven ideal.

Herein, it is noted that the maximum bending of the respective lip has to be understood as the maximum bending in respect to the resting condition of the lip, i.e. in respect to the condition of the lip in not-coupled or not-installed condition of the floor panels.

The maximum bending can be obtained in a simple manner in the case that the elastic bending relates to a downward bending, wherein the term "downward" has to be interpreted relative in respect to the installation plane of the floor panels.

For example, this may relate to a downward bending, wherein the lip of the receiving hook partially is situated lower than a level defined by the lower side of the floor panel to which the locking hook is belonging.

The elastic bending preferably relates to a bending continuously increasing in distal direction in respect to the receiving hook, wherein said maximum bending occurs at the distal end of the lip of the receiving hook. As the mentioned maximum bending is achieved by means of a continuously increasing bending, the advantage is obtained that a particularly effective tensioning force can be realized without thereby creating an appreciable risk of breaking or damage. In fact, the load to which the respective lip is subjected can be distributed over the length of the respective lip.

The herein above-mentioned advantages primarily will be apparent in the case that the lip of the receiving hook is bent at least over 25%, and preferably at least over 50% of its length, and still more when the respective lip is bent over at least 75% of its length.

It is also noted that the term "thickness" indicates the dimension according to the direction perpendicular to the upper or lower side of the floor panel. In particular, by the overall thickness of the floor panel the distance is indicated between the upper and lower sides of the floor panel.

It is also noted that the term "length" has to be understood as the dimension according to the direction parallel to the upper or lower side and perpendicular to the edges.

According to a second independent aspect thereof, the present invention relates to a set of floor panels for forming a floor covering, of the aforementioned type, with the characteristic that the coupling parts are configured such that they, in the coupled condition, realize a tensioning force pressing the coupled edges towards each other, by means of an elastic bending of the lip of the receiving hook; and that the coupling parts are configured such that at least a portion of the locking part extending towards the lower side of the floor panel fits into an opening defined between the portion extending towards the upper side of the floor panel and a proximal side of the receiving hook, without having to elastically bend the lip of the receiving hook to this aim. Herein, by the term "opening" a recess or groove is meant which is provided in the lip of the receiving hook, and in which the locking part of the locking hook directed towards the lower side of the floor panel becomes seated in the coupled condition of the floor panels.

This configuration of the coupling parts offers the advantage that the smoothness of installation of the floor panels can be guaranteed although they are provided with a pretension.

Moreover, the elastic bending of the lip of the receiving hook can be initiated starting from an already partially engaged condition of the hook-shaped parts. Consequently, the risk of a difficult engagement of the hook-shaped parts, for example, as a result of the elastic deformation of the respective lip, can be minimized or even excluded.

For example, the elastic bending is initiated by a mutual interaction of proximal sides, more particularly locking surfaces, of the locking parts.

According to an independent third aspect thereof, the present invention relates to a set of floor panels for forming a floor covering, of the aforementioned type, with the characteristic that the coupling parts are configured such that they, in the coupled condition, realize a tensioning force pressing the coupled edges towards each other, by means of an elastic bending of the lip of the receiving hook; and that the lip of the receiving hook has a minimum thickness which is at least ⅕ times and at most ⅓ of the overall thickness of the floor panel; and that the length of the lip of the receiving hook, measured between the vertical closing surface and the distal end of the lip, is at least 1 times and at most 3/2 times the overall thickness of the floor panel. Herein, the term "vertical closing surface" has to be understood as the vertical surface defined there, where the upper edges of the floor panels adjoin each other. In other words, this is the vertical surface which is defined there, where a distal side of the locking hook adjoins against a proximal side of the receiving hook.

The realization of the respective lip offers the advantage that, on the one hand, it can be provided with elastic features in order to undergo the elastic bending, and, on the other hand, can be provided with the required strength and stability, such that the forming of gaps can be counteracted in an effective manner and the risk of breaking or damage can be minimized.

A particularly good balance between elasticity and stability can be obtained when said minimum thickness is at most 0.3 times the overall thickness of the floor panel, wherein it has proven ideal when said minimum thickness is at most ¼ times the overall thickness of the floor panel.

With the same aim, the herein above-defined length preferably is at most 1.4 times the overall thickness of the floor panel, wherein said length most preferably is at most 4/3 times the overall thickness of the floor panel.

It is also noted that the term "length" has to be understood as the dimension according to the direction parallel to the upper or lower side and perpendicular to the edges.

According to an independent fourth aspect thereof, the present invention relates to a set of floor panels for forming a floor covering, of the aforementioned type, with the characteristic that the coupling parts are configured such that they, in the coupled condition, realize a tensioning force pressing the coupled edges towards each other, by means of an elastic bending of the lip of the receiving hook; and that the lip of the receiving hook comprises a bridge part connected to the core of the floor panel, and an end part connected to the bridge part, to which the locking part extending towards the upper side of the floor panel is belonging, wherein the bridge part comprises an upper side provided with a recess or groove, which recess, viewed according to the direction parallel to the upper or lower side of the floor panel and perpendicular to the edge, is situated at a distance from there, where the bridge part is connected to the core of the floor panel, and from there, where the bridge part is connected to the end part.

The recess offers the advantage that the lip of the receiving hook can be provided with elastic features in order to allow the elastic bending, however, can be made relatively rigid or stable, such that, via the mentioned tensioning force, it can effectively counteract the formation of gaps, without thereby being subjected to breaking or damage.

The mentioned advantages are particularly apparent in the case that the lip of the receiving hook has its minimum thickness there, where said recess is provided.

There, where the bridge part is connected to the core of the floor panel, and there, where it is connected to the end part, the bridge part preferably is made more rigid or thicker than there, where said recess is provided. In this manner, the risk of breaking or damage can be minimized, in particular there, where the load on the respective lip can be highest.

It can be prevented that the elastically bent lip will break under normal usage conditions, when the bridge part there, where it is connected to the core of the floor panel, has a thickness which is at least ⅕ times, and preferably at least ¼ times the overall thickness of the floor panel.

Moreover, the bent lip can be enabled to compensate external forces, to which the locking part of the receiving hook can be subjected under normal usage conditions, without damage, in the case that the bridge part there, where it is connected to the end part, has a thickness which is at least ⅕ times, and preferably at least ¼ times the overall thickness of the floor panel.

According to an independent fifth aspect thereof, the present invention relates to a set of floor panels for forming a floor covering, of the aforementioned type, with the characteristic that the coupling parts are configured such that they, in the coupled condition, realize a tensioning force pressing the coupled edges towards each other; and that the coupling parts are configured such that they allow to uncouple the floor panels, starting from the coupled condition, by means of a rotational movement of the one floor panel around the other floor panel, around an axis parallel to the installation plane and the edges, wherein the upper sides of the floor panels during said rotational movement are moved towards each other.

The advantage is obtained that the floor panels, from the coupled condition, in which the edges are pressed towards each other, can be uncoupled in a simple manner. Thus, the user is offered the opportunity of a simple de-installation of the floor panels coupled with tensioning force.

The tensioning force preferably is realized by means of an elastic bending of the lip of the receiving hook.

The lip of the receiving hook preferably comprises a bridge part connected to the core of the floor panel, and an end part connected to the bridge part, to which end part the locking part extending towards the upper side of the floor panel is belonging. There, where the bridge part is connected to the end part, it preferably has a thickness which is at least ⅕ times and preferably at least ¼ times the overall thickness of the floor panel. That the bridge part there, where it is connected to the end part, is made relatively thick, offers the advantage that the proximal side, more particularly the locking surface, of the locking part extending towards the upper side of the floor panel, can be lifted, which facilitates the pivoting apart of the floor panels.

According to a sixth independent aspect thereof, the present invention relates to a floor panel for forming a floor covering, of the aforementioned type, with the characteristic that the coupling parts are configured such that they, in the coupled condition, realize a tensioning force pressing the coupled edges towards each other, by means of an elastic bending of the lip of the receiving hook; that each of the floor panels comprises an edge adjacent to its aforementioned edge, herein below denominated adjacent edge, which is provided with a coupling part, wherein the coupling parts at the adjacent edges are configured such that they allow realizing a coupled condition between the floor panels, wherein the coupling parts at the adjacent edges, in coupled condition, effect a locking in the direction parallel to the installation plane and perpendicular to the adjacent edges, as well as a locking in the direction perpendicular to the installation plane, and wherein the coupling parts at the adjacent edges are configured such that they, in coupled condition, realize a tensioning force which, by means of an elastic bending of a lip pertaining to the coupling parts of the adjacent edges, presses the adjoining coupled edges towards each other; and that, in the coupled condition of a plurality of the floor panels, the average degree of bending of the lip of the receiving hook, viewed over the length of the coupled edges, differs from the average degree of bending of the lip pertaining to the coupling parts of the adjacent edges, viewed over the length of the coupled adjacent edges. Herein, it is noted that the "length of the edges" here has to be understood as the dimension of these edges in the direction parallel to the edges and the installation plane.

As the average bending of the respective lips is different, the advantage is obtained that an additional degree of freedom is created for optimizing the features of the floor covering, for example, in the field of water or dust resistance.

The inventor has found that it is particularly advantageous, in respect to the smoothness of installation, that the average degree of bending of the lip of the receiving hook is larger than the average degree of bending of the lip pertaining to the coupling parts of the adjacent edges. Specific advantages thereof will be explained in more detail in the detailed description.

The coupling parts at the adjacent edges preferably are configured such that they allow realizing the coupled condition between the floor panels by means of a rotational movement of the one floor panel in respect to the other floor panel, around an axis parallel to the installation plane and the adjacent edges, in such a manner that a plurality of the floor panels can be coupled by means of a fold-down movement.

For example, the coupling parts at the adjacent edges can be realized as a tongue and a groove, wherein the groove is bordered by an upper lip and said lip pertaining to the coupling parts of the adjacent edges, herein below denominated lower lip, which lower lip preferably extends beyond the distal end of the upper lip. The tongue and the groove may be provided with lock-up parts, which in coupled condition effect said locking in the direction parallel to the installation plane and perpendicular to the adjacent edges.

It is also noted that the characteristics of the herein above-described six aspects within the scope of the invention can be combined at choice, as far as they are not contradictory.

Herein below, preferred, as well as alternative and possible embodiments of the present invention are described, which, as such or in combination, can be applied to the herein above-described six aspects, as far as they are not contradictory.

It is also noted that, if not stated otherwise, herein below by the terms "edges" and "coupling parts", respectively the edges are meant which are provided with the coupling parts which are made in the form of the herein above-described hook-shaped parts, and the coupling parts are meant which are made in the form of the herein above-described hook-shaped parts.

The ease of installation of the floor panels provided with pretension is promoted, in the case that the locking part extending towards the upper side of the floor panel defines a point situated most towards the upper side of the floor panel, which point is situated in the lower half of the floor panel. Moreover, such embodiment of the respective locking part facilitates the possibility of pivoting the floor panels out of each other in order to uncouple them.

It is beneficial for the strength and solidity of the lip of the receiving hook when it comprises a bottom side which is free from recesses or grooves.

The locking in the direction perpendicular to the installation plane, at the edges to which the hook-shaped parts are pertaining, preferably is effected by means of locking elements, of which more particularly at least one locking element is realized as a separate insertion piece or insert. The advantage of such insertion piece is that the features thereof can be adapted, on the one hand, in order to couple the floor panels in a smooth manner, irrespective of the overlapping embodiment of the coupling parts, and, on the other hand, to be able to provide for a strong vertical locking, separate from the material of which the actual floor panel is manufactured.

Preferably, the insert is provided in a groove present in a distal side of the locking hook. Such groove can be provided without any noteworthy weakening of the locking hook and, more important, without a disadvantageous influence on the stability or solidity of the lip of the receiving hook and the tensioning force supplied by the lip.

However, the invention does not exclude that the insert is placed in a groove provided in a proximal side of the receiving hook. However, such groove can have a detrimental influence on the stability of the lip of the receiving hook and consequently on the tensioning force supplied by the lip.

Preferably, the insert comprises an elastically bendable portion, which, during the coupling movement, performs a lateral movement and is brought from a relaxed or initial condition towards a locking condition, in which the movable portion cooperates with the locking element at the other floor panel. The advantage of such elastically bendable portion is that the elasticity thereof can be applied for promoting the coupling of the floor panels, irrespective the overlapping embodiment of the contours of the coupling parts.

For example, the insert may comprise a pivotable blocking body, as known as such from documents WO 2008/068245 A1 and WO 2013/102804 A2, or consist of a displaceable tongue which is provided in a displacement groove, as known as such from WO 2006/043893 A1.

In the locking condition, the aforementioned movable part can at least be partially tensioned, by which the movable part realizes a tensioning force. That the movable part is tensioned in the coupled condition, offers the advantage that the contact of that part with the locking element on the other floor panel can be guaranteed. In this manner, a good locking in the direction perpendicular to the installation plane is obtained, and the risk of the occurrence of height differences between the upper sides of the floor panels can be minimized.

The tensioning force supplied by the movable part and the tensioning force supplied by the lip of the receiving hook preferably are configured such that the coupled edges are pressed towards each other. For example, the tensioning force supplied by the movable part comprises at least a force component, which presses the coupled edges out of each other, wherein this force component is smaller than the force component of the tensioning force supplied by the lip of the receiving hook, which presses the coupled edges towards each other. In other words, the resultant of the tensioning forces provides for that the coupled edges still are pressed towards each other.

Herein, it is also noted that it has proven particularly advantageous to realize the insert as a coextruded strip, as known as such from WO 2009/066153 A2. In fact, by means of coextrusion the insert can be realized such that it effects a strong vertical locking and also allows a smooth installation, irrespective of the overlapping design of the coupling parts.

However, it is noted that the present invention does not exclude that the vertical locking is effected without the assistance of an insertion piece or insert, and that the herein above-mentioned locking elements all are manufactured from the material of the core of the floor panels and are made in one piece therewith.

On one distal side thereof, the locking part extending towards the upper side of the floor panel preferably is free from locking elements. In particular, in the coupled condition of the floor panels a room or space is formed between said distal side and the opposite edge. Hereby, the advantage is obtained that the respective lip can be bent out easily, as by means of said space room is made for that.

Each of the aforementioned locking parts preferably is provided with a locking surface on a proximal side of the locking part, wherein the locking surfaces in coupled condition cooperate such that they effect at least the locking in the direction parallel to the installation plane and perpendicular to the edges. These locking surfaces preferably are made of the material of the core of the floor panels and are made in one piece therewith.

Although it is not excluded that the locking surfaces assist in the locking in the direction perpendicular to the installation plane, they preferably will not do this. The fact that they do not assist in the mentioned locking, contributes to a smooth installation of the floor panels which have to be coupled with a tensioning force.

For example, the locking surface of the locking part extending towards the upper side of the floor panel extends in distal direction towards the upper side of the floor panel.

The inventor has found that the ease of installation of the floor panels which have to be coupled with a tensioning force is promoted in the case that the locking surfaces, in coupled condition, define a maximally inclined tangent line, which at most forms an angle of 85 degrees with a straight line parallel to the installation plane, wherein the tangent line extends towards the upper side of the floor panel, in distal direction in respect to the receiving hook. It has proven particularly advantageous when said angle is at most 80 degrees, wherein most preferably said hook is approximately 75 degrees.

Preferably, the coupling parts are configured such that they allow realizing a coupled condition between the floor panels, by means of a rotational movement of the one floor panel in respect to the other floor panel, around an axis parallel to the installation plane and perpendicular to the edges. Such configuration of the coupling parts allows coupling a plurality of such floor panels to each other by means of a fold-down movement, which movement shows the herein above-described advantages particularly well.

In view of the fact that the present invention allows minimizing the risk of penetrating moisture and dust, it is primarily applied in an advantageous manner with floor panels, the core of which is at least partially composed of wood-based materials, such as MDF, HDF, or Wood Plastic Composite or WPC.

However, the invention can also be applied in an advantageous manner with floor panels which comprise a core based on synthetic material, wherein a variety of synthetic materials can be applied, such as thermoplastics, elastomers, polyesters and the like. A particular type of synthetic material-based floor panels, wherein the invention can be applied in an advantageous manner, are the so-called LVT floor panels.

The floor panels preferably have an overall thickness which is situated between 4 and 15 mm. Such thickness allows realizing the floor panels still stable enough. Most preferably, the overall thickness is situated between 5 and 12 mm, wherein an overall thickness of approximately 8 mm has proven to be an ideal value for realizing the elastically bent lip described herein above.

The floor panels of the present invention primarily relate to decorative floor panels. Preferably, they relate to floor panels comprising a top layer, wherein the top layer comprises at least a decor and a transparent wear layer.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS

Figure 1:
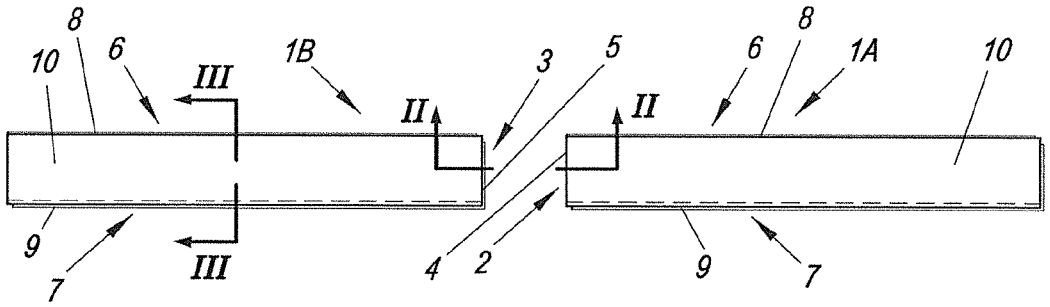
FIG. 1 in top view represents a set of oblong rectangular floor panels, wherein the floor panels are in a not-coupled or not-installed condition.

FIG. 1, in top view, represents a set of floor panels 1A-1B for forming a floor covering, wherein the floor panels 1A-1B here are oblong rectangular and thus comprise a pair of short sides and a pair of long sides. The floor panels 1A-1B are represented in a not-coupled or not-installed condition.

The opposite short sides of the floor panels 1A-1B form edges 2-3 which are provided with coupling parts 4-5. Although here opposite edges 2-3 of two floor panels 1A-1B are concerned, it is clear that these edges 2-3 can also relate to edges of one and the same floor panel, which then relate to opposite edges of that floor panel.

The long sides of the floor panels 1A-1B form edges 6-7, which are provided with coupling parts 8-9.

Figure 2:
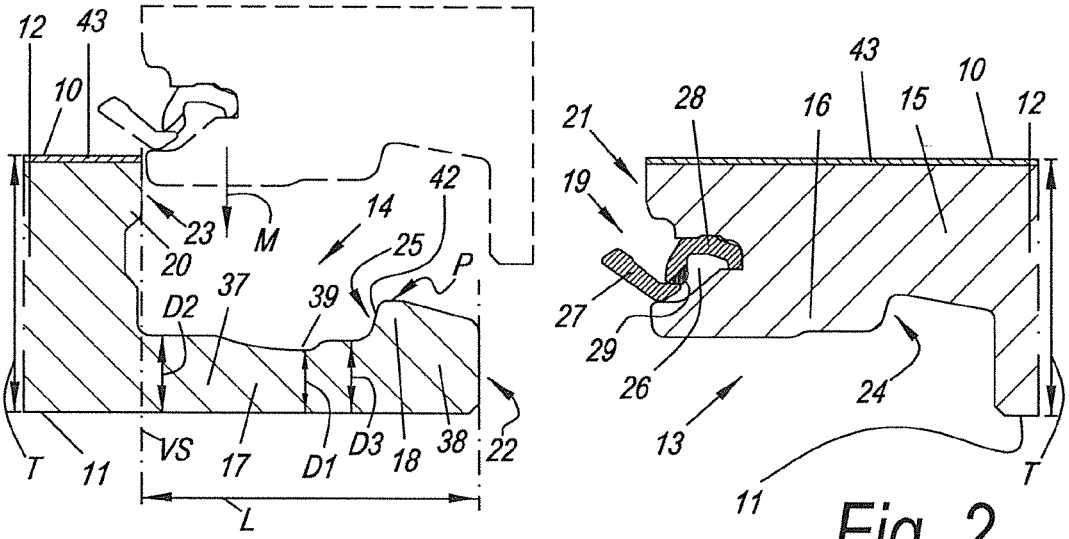
FIG. 2 represents a cross-section according to line II-II in FIG. 1.

FIG. 2 represents a cross-section according to line II-II in FIG. 1. Thus, FIG. 2 represents a cross-section wherein the coupling parts 4-5 on the short sides of the floor panels 1A-1B are visible.

The floor panels 1A-1B each comprise an upper side 10, a lower side 11, and a core 12 extending between the upper and lower sides 10-11.

The floor panels 1A-1B relate to decorative floor panels, which comprise a top layer 43, wherein the top layer comprises at least a decor and a transparent wear layer.

The coupling part 4 of the one floor panel 1A is realized as a hook-shaped part 13 directed towards the lower side 11 of the floor panel 1A, herein below denominated looking hook 13.

The coupling part 5 of the other floor panel 1B is realized as a hook-shaped part 14 directed towards the upper side 10 of the floor panel 1B, herein below denominated receiving hook 14.

The hook-shaped parts 13-14 substantially are made from the material of the core 12 of the floor panels 1A-1B and substantially are made in one piece therewith. Here, the hook-shaped parts 13-14 even are made entirely from the material of the core 12, and in one piece therewith, with the exception of the insertion piece 19. To this aim, the hook-shaped parts 13-14 can be manufactured, for example, from the material of the core 12 by means of milling treatments, which is an economically advantageous and efficient manner of manufacturing the hook-shaped parts 13-14.

The locking hook 13 comprises a lip 15 which is provided with a locking part 16 extending towards the lower side 11 of the floor panel 1A.

The receiving hook 14 comprises a lip 17 which is provided with a locking part 18 extending towards the upper side 10 of the floor panel 1B.

As illustrated by means of the coupling part 4 represented in dotted line, the coupling parts 4-5 are configured such that they allow realizing a coupled condition between the floor panels 1A-1B, by means of a substantially straight coupling movement M of the one floor panel 1A in respect to the other floor panel 1B, according to a direction substantially perpendicular to an installation plane.

More particularly, the coupling parts 4-5 here are configured such that they also allow realizing a coupled condition between the floor panels 1A-1B, by means of a rotational movement of the one floor panel 1A in respect to the other floor panel 1B, around an axis parallel to the installation plane and perpendicular to the edges 2-3, in order to be able to perform the fold-down movement, which will be described in greater detail in respect to FIG. 4.

Figure 5:
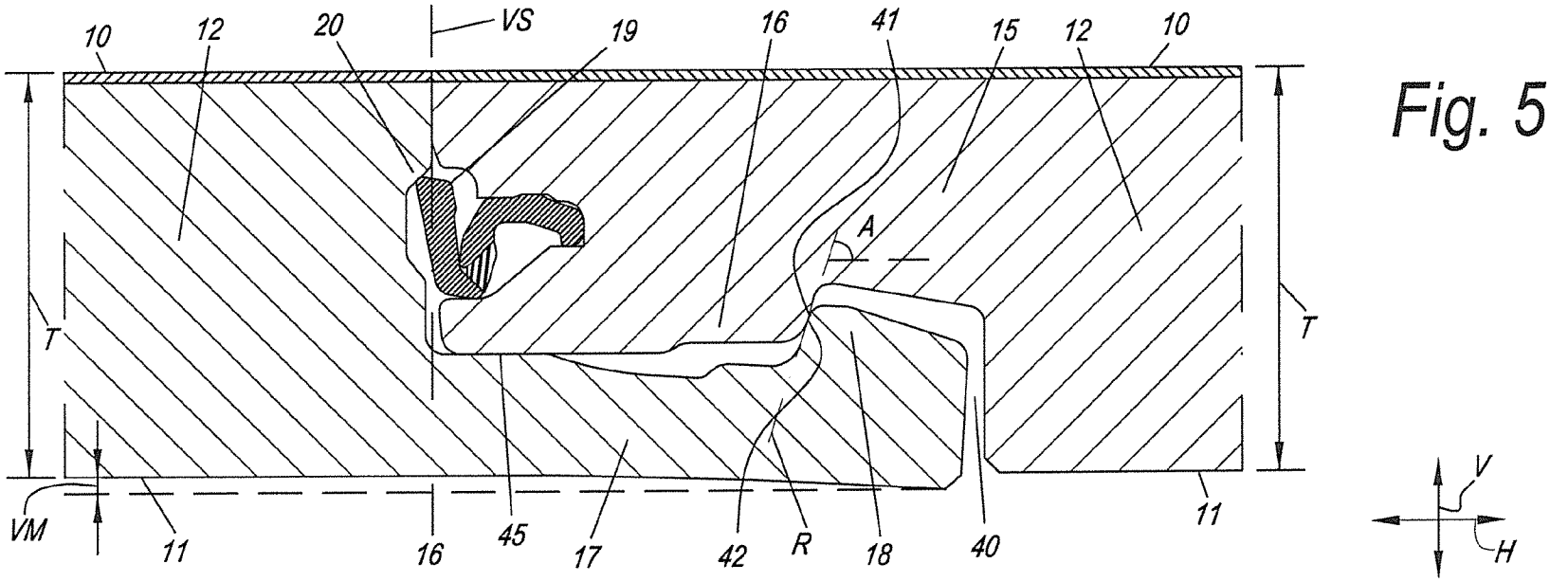
FIG. 5, in an enlarged view, represents the edges from FIG. 2, however, in the coupled condition of the floor panels.

In the coupled condition of the floor panels 1A-1B, which is illustrated in greater detail in FIG. 5, the coupling parts 4-5 effect a locking in the direction H parallel to the installation plane and perpendicular to the aforementioned edges 2-3, as well as a locking in the direction V perpendicular to the installation plane.

Here, the locking parts 16 and 18 perform the locking in the direction H parallel to the installation plane and perpendicular to the aforementioned edges 2-3.

The locking in the direction V perpendicular to the installation plane is effected by means of locking elements 19-20. The locking element 19 here is realized as a separate insertion piece or insert, as known as such from, for example, the herein above-mentioned WO '804.

The insert 19 here is provided in a groove 26, which is present in a distal side 21 of the locking hook 13. This offers the advantage that such groove 26 does not have to be provided in the receiving hook 14, which then as a result thereof can be made strong and can render sufficient stability to the lip 17.

However, it is not excluded that such insert 19 is provided in a groove which is present in a proximal side 23 of the receiving hook 14, which then preferably, instead of an upward-directed part 27, comprises a downward-directed part.

Figure 6:
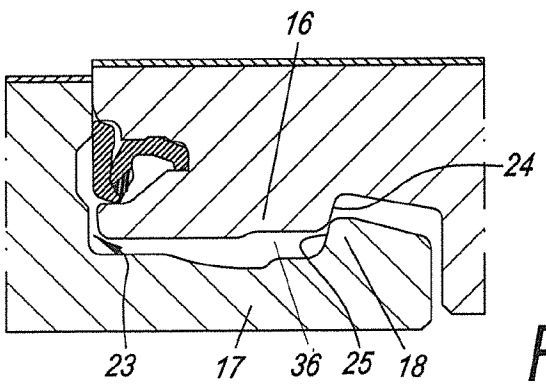
FIG. 6 represents a step in the coupling movement of the edges at the short sides of the floor panels from FIG. 1.

The part 27 is elastically movable, for example, by elastic bending and/or compression, and during the coupling movement performs a lateral movement, illustrated in greater detail in FIG. 6.

It is clear that here, and also in general, by the term "lateral movement" a sideward movement is meant which has at least a movement component in the direction parallel to the installation plane and perpendicular to the edges 2-3.

It should be noted that the part 27 here primarily, starting from a relaxed or initial condition, will perform a movement in the direction towards the floor panel 1A, after which the part 27 subsequently will at least partially relaxate towards a locking condition and herein will move in the direction towards the floor panel 1B.

In the locking condition, the part 27 works in conjunction with the locking element 20 at the other floor panel 20, shown in more detail in FIG. 5. Preferably, the part 27 relaxates only partially, as a result of which it is at least partially tensioned in the locking condition and realizes a tensioning force.

The insert 19 here is provided in the groove 26 by means of an attachment part 28, which can be clamped in this groove 26, for example, in that the part 28 is made not precisely fitting with the groove 26.

Here, the attachment part 28 more particularly is connected to the movable part 27 by means of a connection part 29.

More particularly, the insert 19 here is made as a coextruded strip, wherein the connection part 29 is manufactured of a softer or more elastic material than the material of the parts 27 and 28, which principle is known as such from, for example, the herein above-mentioned WO '153.

The lip 17 of the receiving hook 14 comprises a bridge part 37 connected to the core 12 of the floor panel 1B, and an end part 38 connected to the bridge part 37, to which end part the locking part 18 extending towards the upper side of the floor panel is belonging.

The bridge part 37 comprises an upper side provided with a recess 39. The recess 39, viewed according to the direction parallel to the upper or lower side 10-11 of the floor panel 1B and perpendicular to the edge 3, is situated at a distance from there, where the bridge part 37 is connected to the core 12 of the floor panel 1B, and from there, where the bridge part 37 is connected to the end part 38.

There, where the recess 39 is provided, the lip 17 has its minimum thickness D1, which preferably is at least ⅕ times and at most ⅓ times the overall thickness of the floor panel 1B. More particularly, the minimum thickness D1 here is at most ¼ times the overall thickness T of the floor panel 1B.

There, where the bridge part 37 is connected to the core 12 of the floor panel 1B and there, where it is connected to the end part 38, it is made more rigid or thicker than there, where the aforementioned recess 39 is provided.

There, where the bridge part 37 is connected to the core 12, said bridge part has a thickness D2 which is at least ⅕ times and preferably at least ¼ times the overall thickness T of the floor panel 1B.

There, where the bridge part 37 is connected to the end part 38, said bridge part has a thickness D3 which is at least ⅕ times and preferably at least ¼ times the overall thickness T of the floor panel 1B.

That the bridge part 37 is made more rigid or thicker in the specific zones offers the advantage that the lip 17 is strong and can withstand possible loads which it is subjected to, in particular in the zones. Moreover, the additional advantage is obtained that, in that the bridge part 37 there, where it is connected to the end part 38, is made thicker, the locking surface 42 can be lifted, i.e. can be brought towards a higher or more upward position, which promotes the smooth pivoting apart of the floor panels, illustrated in more detail in FIG. 7.

The length L of the lip 17, measured between the vertical closing surface VS and the distal end of the lip 17, is at least 1 time and at most 3/2 times the overall thickness T of the floor panel 1B. In particular, the length L here is at most 4/3 times the overall thickness T of the floor panel 1B.

The lip 17 of the receiving hook 14 comprises a lower side which is free from recesses or grooves, or weakened parts in general.

The locking part 18 defines a point P situated most towards the upper side 10 of the floor panel 1B, which point is located in the lower half of the floor panel 1B. Such rather low designed locking part 18, amongst others, offers the advantage that the pivoting apart of the floor panels 1A-1B, illustrated in greater detail in FIG. 7, can be performed in a smooth manner.

Figure 3:
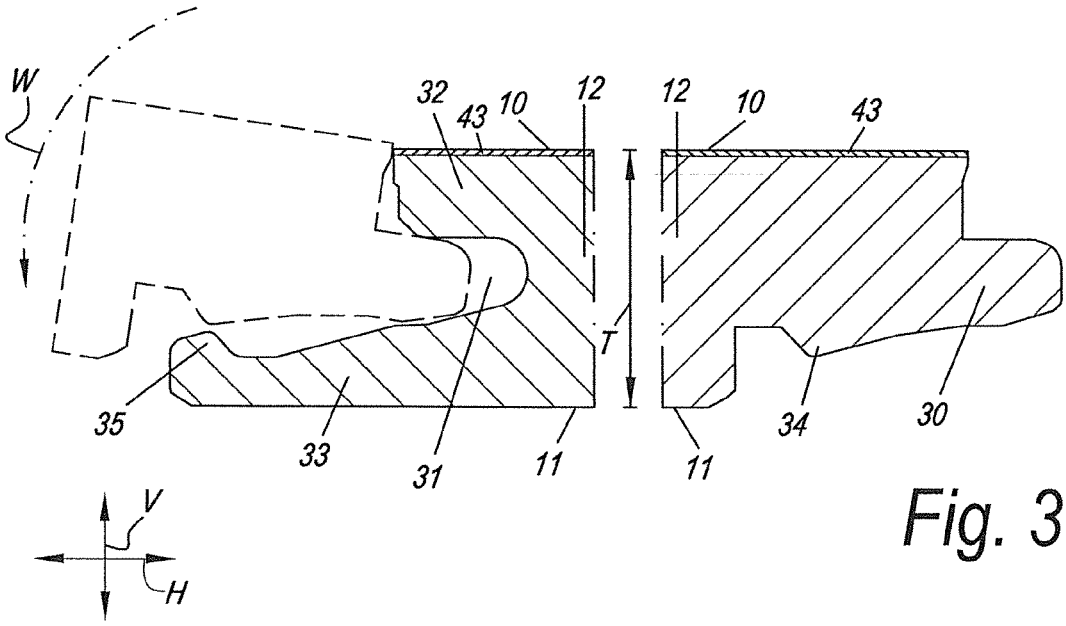
FIG. 3 represents a cross-section according to line in FIG. 1.

FIG. 3 represents a cross-section according to line III-III in FIG. 1. Thus, here a cross-section is represented wherein the coupling parts 8-9 on the long sides of the floor panels 1B are visible.

More particularly, the coupling parts 8-9 are realized as a tongue 30 and a groove 31, respectively, wherein the groove 31 is bordered by an upper lip 32 and a lower lip 33, which lower lip 33 extends beyond the distal end of the upper lip 32. The tongue 30 and the groove 31 are provided with lock-up parts 34-35. In the coupled condition, they effect the locking in the direction parallel to the installation plane and perpendicular to the edges 6-7.

As illustrated by the coupling part 8 represented in dotted line, the coupling parts 8-9 are configured such that they allow realizing the coupled condition between the floor panels 1A-1B, by means of a rotational movement W of the one floor panel 1A in respect to the other floor panel 1B, according to a direction parallel to the installation plane and the edges 6-7.

Locking tongue and groove connections, such as those described herein above in respect to FIG. 3, are known as such, amongst others, from the already mentioned herein above WO '834. From that document, it is known that such tongue and groove connections can be provided with pretension, i.e., that they, in the coupled condition, realize a tensioning force pressing the coupled edges towards each other, for example, by means of an elastic bending of the lower lip. Herein, it is noted that with such locking tongue and groove connections the pretension poses less difficulties in respect to the smoothness of installation, as they are coupled by means of a pivoting or rotational movement, as described herein above.

Figure 4:
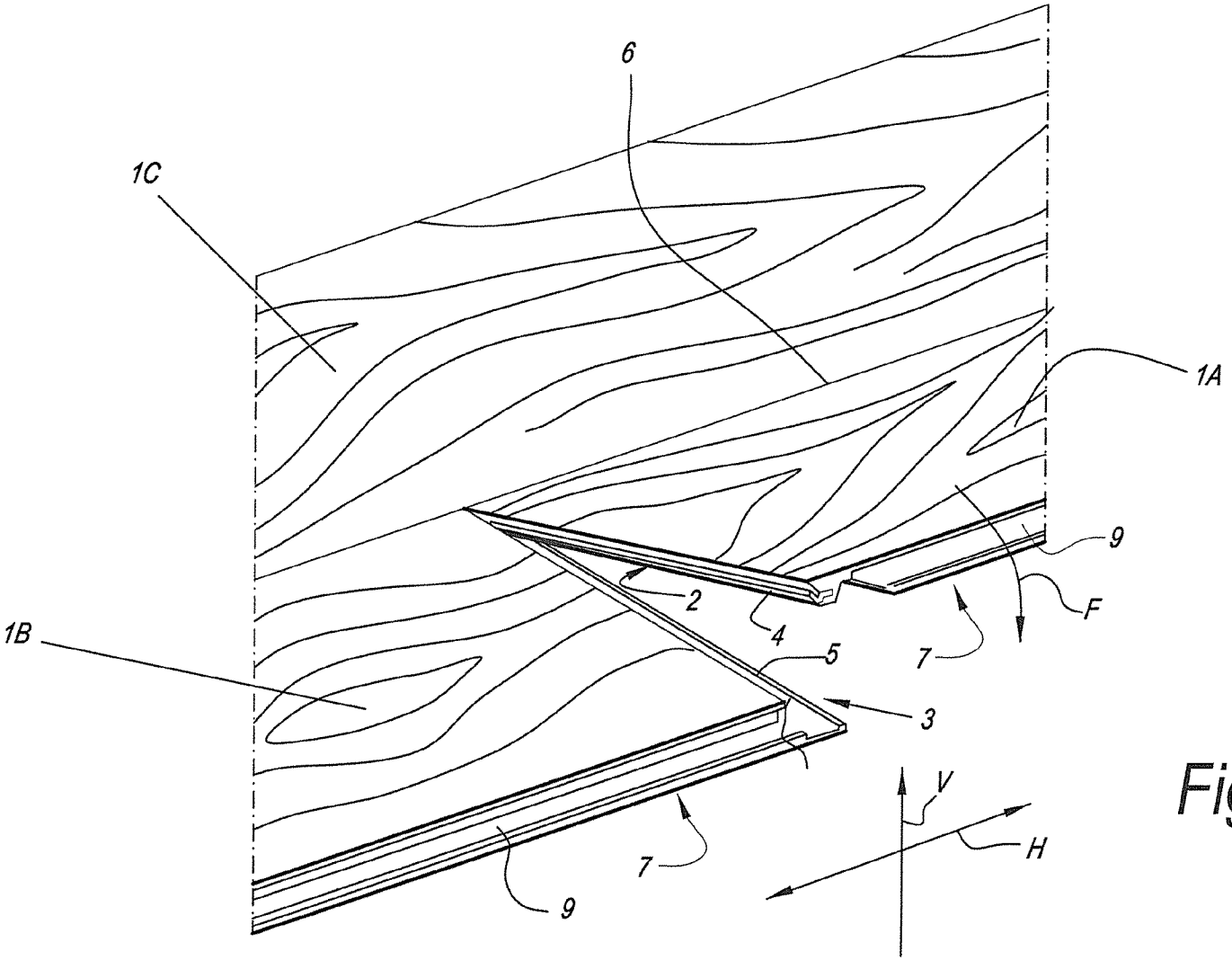
FIG. 4 represents how a plurality of the floor panels of FIG. 1 can be coupled to each other.

FIG. 4 represents how a plurality of the floor panels of FIG. 1 can be coupled by means of the so-called fold-down movement F, which as such is known, amongst others, from WO 01/75247 A1 and, already mentioned herein above, WO '153.

As illustrated, the floor panel 1A is coupled at its long side to an already installed floor panel 1C from a preceding row, by means of a pivoting movement, and at the same time is coupled at its short side to an already installed floor panel 1B from the same row, by means of the same pivoting movement, which is also called a scissor movement.

It is noted that the fold-down movement in practice mostly is preceded by a shifting movement of the floor panel 1A in respect to the floor panel 1C, along the long sides of these floor panels 1A and 1C, wherein the tongue during this shifting movement already is partially introduced into the groove. Herein, the floor panel 1A is in an inclined condition.

The floor panels 1A-1B-1C here are represented as perfectly rectangular floor panels, i.e. the short sides are perpendicular to the long sides. However, in practice this is not always the case. The standard EN 13329 namely allows a deviation from perpendicularity of 0.2 mm over the length of the side. It is clear that, due to this allowed deviation, performing the fold-down movement can be impeded; certainly at the sides where the coupling parts are realized in the form of hooks, here, thus, at the short sides, as these hooks due to the non-perpendicularity are difficult to engage into each other, certainly in the case of hooks made overlapping, which is the case with pretension.

Now, the inventor has found that the smoothness of installation still can be guaranteed by means of the herein above-described measures and the characteristics explained herein below in greater detail by means of FIGS. 5 and 6.

FIG. 5 in an enlarged view represents the edges 2-3 from FIG. 2, however, in the coupled condition of the floor panels 1A-1B.

As made visible, the coupling parts 4-5 are configured such that they, in coupled condition, realize a tensioning force pressing the coupled edges 2-3 towards each other, by means of an elastic bending of the lip 17 of the receiving hook 14.

Herein, the lip 17 has a maximum bending VM of at most 0.0625 times the overall thickness T of the floor panel 1B and this maximum bending here is specifically equal to approximately 0.0125 times the overall thickness of the floor panel 1B. The inventor has found that such maximum bending VM allows realizing an effective tensioning force which presses the coupled edges 2-3 towards each other, and that the smoothness of installation still can be guaranteed.

Herein, it is noted that the maximum bending VM of the lip 17 has to be understood as the maximum bending in respect to the resting condition of the lip 17, i.e. in respect to the condition of the lip 17 in not-coupled or not-installed condition of the floor panels 1A-1B, which is represented in FIG. 2.

Here, the bending of the lip 17 relates to a downward bending, wherein the lip 17 partially is situated lower than a level defined by the lower side 11 of the floor panel 1A to which the locking hook 13 is belonging.

Moreover, the bending relates to a bending continuously increasing in distal direction in respect to the receiving hook. By this is meant that the lip 17 is bent out more and more in distal direction, which in FIG. 5, for example, is represented by a more and more diminishing distance between the lower side of the lip 17 and the represented dotted line. The maximum bending VM then occurs at the distal end of the lip 17.

Such continuously increasing bending offers the advantage that the tension to which the lip 17 is subjected, can be spread over the length of this lip 17, and that an effective tensioning force can be realized without a noteworthy risk of breaking or damage of the lip 17.

Thus, the lip 17 preferably is bent over at least 25%, and still better over 50%, of its length.

As already described herein above, also the coupling parts 8-9 on the long edges 6-7 can be provided with pretension, wherein a tensioning force is created, which presses the coupled edges 6-7 towards each other, for example, by means of an elastic bending of the lower lip 33.

Herein, it is preferred that the average degree of bending of the lip 17 of the receiving hook 14, viewed over the length of the coupled edges 2-3, is different from, and preferably larger than, the average degree of bending of the lip 33 belonging to the coupling parts 8-9 of the adjacent edges 6-7, seen over the length of the coupled adjacent edges 6-7.

It is noted that by the length of the edges here the dimension of the edges in a direction parallel to these edges is meant.

That the bending of the lip 17 is larger than the bending of the lip 33, offers the advantage that a smooth installation can be guaranteed, whereas the formation of gaps on the coupled edges 2-3 and 6-7 can be counteracted in an optimum manner, certainly with oblong rectangular floor panels, such as those from FIG. 1.

On the one hand, it is advantageous that the bending of the lip 33 is relatively small, and smaller than the bending of the lip 17, as this allows smoothly performing the shifting movement of the floor panels 1A and 1C along their long sides, already described herein above, prior to the actual fold-down movement. On the other hand, it is advantageous to perform the bending of the lip 17 relatively large, and larger than the bending of the lip 33, as this results in a reduction of the risk of the penetration of moisture or dust at the short sides of the coupled floor panels 1A-1B.

As mentioned earlier in respect to FIG. 2, the movable part 27 of the insert 19 in the locking position can be partially tensioned, such that it realizes a tensioning force. This tensioning force provides for that the risk of height differences between the floor panels 1A-1B can be minimized or even excluded.

The tensioning force delivered by the part 27 here comprises at least a force component which pushes the coupled edges 2-3 out of each other, however, wherein this force component is smaller than the force component of the tensioning force delivered by the lip 17, which presses the coupled edges towards each other, such that the coupled edges 2-3 still are pressed towards each other.

At its distal side 22, the locking part 18 is free from locking elements. In the coupled condition, even a room or space 40 is formed between the distal side 22 and the opposite edge 2. This space 40 offers room for the elastic bending of the lip 17.

In the coupled condition, the locking surfaces 41-42 at the proximal sides 24-25 of the locking parts 16 and 18 cooperate such that they effect the locking in the direction H parallel to the installation plane and perpendicular to the edges 2-3. They are manufactured from the material of the core 12 of the floor panels 1A-1B and are made in one piece therewith.

The locking surface 42 extends in distal direction towards the upper side 10 of the floor panel 1B.

The locking surfaces 41-42 define a maximally inclined tangent line R, which forms an angle A of at most 85 degrees with a straight line parallel to the installation plane, wherein the tangent line R extends towards the upper side 10, in distal direction in respect to the receiving hook 14. Here, the angle A is equal to approximately 75 degrees.

The bridge part 37 also defines a support surface 45, which here more particularly is made horizontal. In the coupled condition of the floor panels 1A-1B, the locking part 16 rests on this support surface 45. The support surface also serves as a reference.

It is advantageous that this support surface 45 is situated in that zone of the bridge part 37 which is made rigid/thicker and moreover little or not at all experiences the elastic bending of the lip 17. So, this support surface 45, which also functions as a reference, always can be well defined.

FIG. 6 represents a step in the coupling movement of the edges 2-3 of the floor panels 1A-1B from FIG. 1.

As represented, the coupling parts 4-5 are configured such that at least a portion of the locking part 16 fits in an opening 36 defined between the locking part 18 and the proximal side 23 of the receiving hook 14, without having to elastically bend the lip 17 for this purpose.

In other words, the hook-shaped parts 13-14, in the step represented in FIG. 6, already are situated in a partially engaged condition of the hooks 13-14, without the lip 17 being elastically bent for this purpose. From this partially engaged condition, the elastic bending of the lip 17 then can be initiated, in particular by pressing the locking hook 13, from the position represented in FIG. 6, further downward.

It is clear that the bending of the lip 17 here then is initiated by a mutual interaction of the proximal sides 24-25 of the locking parts 16 and 18.

Figure 7:
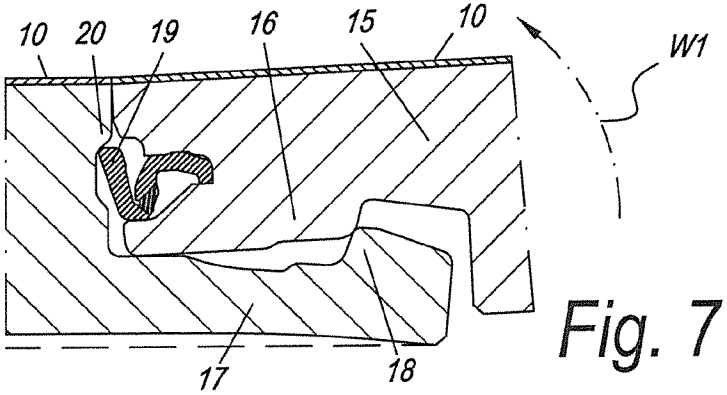
FIG. 7 represents how the floor panels from FIG. 1 can be uncoupled at the edges of their short sides by means of a pivoting movement.

FIG. 7 represents how the floor panels 1A-1B, starting from the coupled condition, can be uncoupled.

The coupling parts 4-5 are configured such that they allow uncoupling the floor panels 1A-1B, starting from the coupled condition, by means of a rotational movement W1 of the one floor panel 1A around the other floor panel 1B, around an axis parallel to the installation plane and the edges 2-3. In this rotational movement W1 the upper sides 10 of the floor panels 1A-1B are moved towards each other.

As illustrated in FIG. 7, the rotational movement W1 can be combined with an elastic bending of the lip 17 of the receiving hook 14.

FIGS. 8 through 11 show more alternatives of the embodiment of the edges 2-3 of the short sides of the floor panels 1A-1B from FIG. 1.

Figure 8:
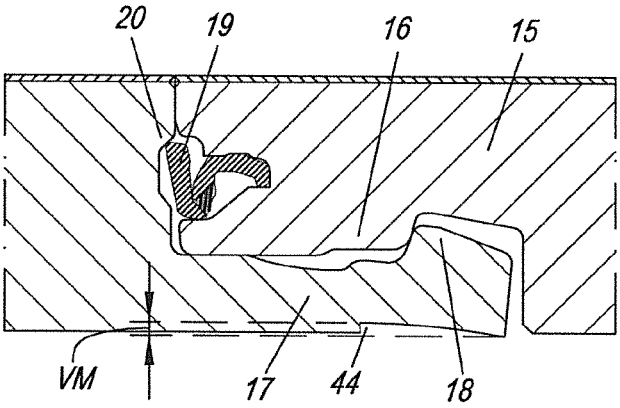
FIGS. 8 through 11 represent alternatives to the embodiment of the edges of the short sides of the floor panels from FIG. 1.

FIG. 8 represents that the lip 17 of the receiving hook 14 can be provided with an elasticity groove 44 in order to increase the elasticity of the lip 17.

The elasticity groove 44 here is provided in a lower side of the lip 17 and extends in distal direction up to the distal end of the lip 17. In proximal direction, the groove 44 more particularly extends to beyond the locking surfaces 41-42 of the locking parts 16 and 18.

It is noted that, as already mentioned herein above, the lower side of the lip 17 preferably is free from grooves or recesses, in order to guarantee the strength of the lip 17.

Figure 9:
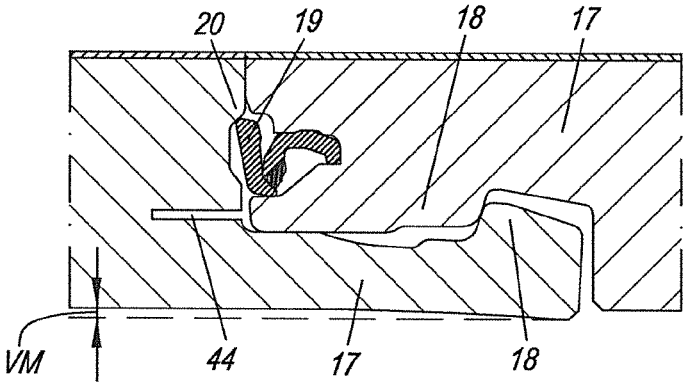

FIG. 9 shows that the elasticity groove 44 can be provided in a proximal side 23 of the receiving hook. The groove 44 then extends more particularly into the core of the floor panel 1B.

It is also noted that the groove 44, provided in the proximal side 23, prolongs the actual length of the lip 17.

Figure 10:
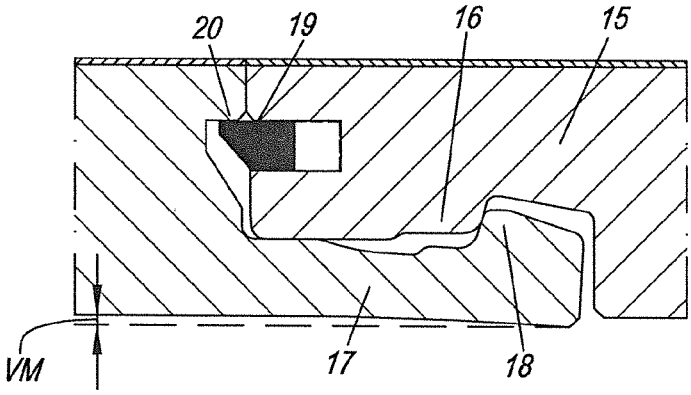

FIG. 10 represents an alternative insertion piece 19, which insertion piece 19 is known as such from the herein above-mentioned WO '893. Here, this relates to a displaceable tongue, which is provided in a displacement groove.

Although the insertion piece 19 here is provided in a groove present in the distal side 21 of the locking hook 13, according to an alternative the insertion piece 19 can be provided in a groove present in the proximal side 23 of the receiving hook 14. In that case, it can be advantageous to make the displacement groove inclined, such that the insertion piece 19 becomes seated inclined in the floor panel 1B.

Figure 11:
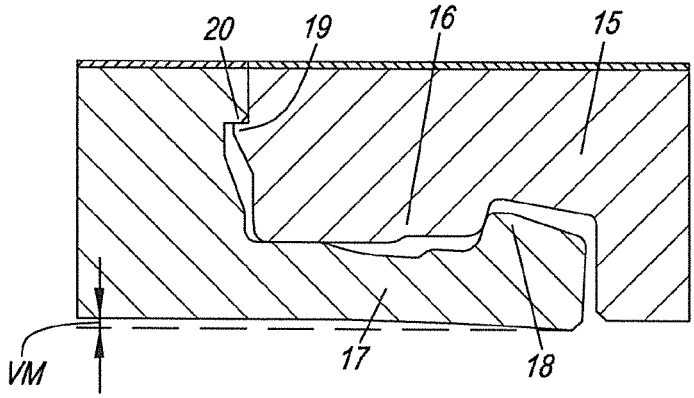

FIG. 11 represents that the locking elements 19-20 can be manufactured from the material of the core 12 of the floor panels 1A-1B, and in one piece therewith. Here, the locking in the direction V perpendicular to the installation plane thus is effected without the assistance of a separate insertion piece or insert.

Herein, the locking element 19 is made as a protrusion at the distal side 21 of the locking hook 13, whereas the locking element 20 is made as an undercut at the proximal side 23 of the receiving hook 14. However, the reverse is possible, too, wherein the locking element 19 is made as an undercut and the locking element 20 as a protrusion.

It is also noted that the floor panels 1A-1B, at their short and/or long sides, can be provided with a so-called bevel or chamfer at the upper edges, as is known as such from WO 01/96688 A1. Such bevel can facilitate the installation of the floor panels even more.

It is also noted that it can be advantageous to provide the coupled edges with a sealing, for example, at the proximal side 23 of the receiving hook 14 and/or at the distal side 21 of the locking hook 13. Such sealing can further reduce or even completely exclude the risk of penetration of moisture or dust.

It is also noted that, although not represented, for the separate insertion pieces 19 use can also be made of inserts which are used in so-called "side-push" systems, which as such are well-known in the art.

It is also noted that the dimensions mentioned in the present description, such as lengths and thicknesses, have to be interpreted in the not-coupled condition of the floor panels, if not stated otherwise.

The present invention is in no way limited to the herein above-described embodiments, on the contrary, such methods, floor panels and carrier material can be realized according to various variants, without leaving the scope of the present invention.

The invention claimed is:

1. A set of floor panels for forming a floor covering, which comprises at least two floor panels, which each comprise an upper side, a lower side, and a core extending between the upper and lower sides, and which each comprise an edge provided with a coupling part and the core extending from the edge to an opposite edge to said edge, wherein the coupling parts are configured such that they allow realizing a coupled condition between the floor panels by means of a substantially straight coupling movement of the one floor panel in respect to the other floor panel, according to a direction substantially perpendicular to an installation plane;

wherein the coupling parts in the coupled condition effect a locking in the direction parallel to the installation plane and perpendicular to said edges, as well as a locking in the direction perpendicular to the installation plane;

wherein the coupling part of the one floor panel is made as a hook-shaped part directed towards the lower side of the floor panel, herein below denominated locking hook, and the coupling part of the other floor panel is made as a hook-shaped part directed towards the upper side of the floor panel, herein below denominated receiving hook;

wherein the hook-shaped parts are manufactured from a material of the core of the floor panels and are made in one piece therewith;

wherein the locking hook comprises a lip which is provided with a locking part extending towards the lower side of the floor panel, and the receiving hook comprises a lip which is provided with a locking part extending towards the upper side of the floor panel;

wherein the locking parts, in the coupled condition, cooperate in such a manner that they effect at least the aforementioned locking in the direction parallel to the installation plane and perpendicular to said edges;

wherein the coupling parts are configured such that they, in the coupled condition, realize a tensioning force pressing the coupled edges towards each other, by means of an elastic bending of the lip of the receiving hook; and wherein the lip of the receiving hook, in the coupled condition, in the direction perpendicular to the installation plane, has a maximum bending of at most 0.0625 times an overall thickness of the floor panel, wherein the receiving hook defines an elasticity groove formed along a lower side of the lip of the receiving hook and has a proximal boundary edge extending vertically and perpendicular to the installation plane into the core toward the upper side, the elasticity groove extends generally horizontally in a distal direction from a proximal end of the lip such that while bending a distal tip at the distal end of the lip undergoes the maximum bending of the lip, said maximum bending is defined as bending of the distal tip of the lip relative to a maximum height of the proximal edge from the lower side of the panel, the distal tip is arranged to be positioned below a plane of the lower side of the panels in the coupled condition, said bending of the lip occurring and pivoting at the proximal boundary edge and extending proximally toward the proximal end of the lip;

wherein locking in the direction perpendicular to the installation plane, at the edges to which the hook-shaped parts belong, is effected by means of locking elements, of which at least one locking element is made as a separate insert from the one and other floor panel, the insert having an attachment part provided in a groove present in a distal side of the locking hook, the insert also having a movable part connected to the attachment part by a connection part and arranged to elastically move relative to the attachment part and into a groove defined by a proximal side of the receiving hook;

wherein the elastic bending of the lip of the receiving hook can be initiated by a mutual interaction of proximal sides, including locking surfaces of the locking parts, said elasticity groove underlying the locking surfaces, and extending distally and proximally horizontally beyond said locking surfaces.

2. The set of floor panels of claim 1, wherein said maximum bending is at most 0.05 times the overall thickness of the floor panel.

3. The set of floor panels of claim 1, wherein the elastic bending relates to a downward bending, wherein the lip of the receiving hook partially is situated lower than a level defined by the lower side of the floor panel to which the locking hook is belonging;

wherein the elastic bending in the distal direction in respect to the receiving hook relates to a continuously increasing bending, wherein said maximum bending occurs at the distal end of the lip of the receiving hook; and wherein the lip of the receiving hook is bent at least over 25% of the length thereof.

4. The set of floor panels of claim 1, wherein the lip of the receiving hook comprises a bridge part connected to the core of the floor panel, and an end part connected to the bridge part, to which end part the locking part extending towards the upper side of the floor panel is pertaining, wherein the bridge part comprises an upper side provided with a recess or groove, which recess, viewed according to the direction parallel to the upper or lower side of the floor panel and perpendicular to the edge, is situated at a first distance from there, where the bridge part is connected to the core of the floor panel, and at a second distance from there, where the bridge part is connected to the end part;

wherein a proximal end of the bridge part defines a flat support surface generally parallel to the upper side of the floor panel and a distal end of the locking hook defines a flat surface generally corresponding to the support surface of the receiving hook and adapted to engage flush therewith.

5. The set of floor panels of claim 4, wherein the lip of the receiving hook shows its minimum thickness there, where said recess is provided.

6. The set of floor panels of claim 4, wherein the bridge part, there, where it is connected to the core of the floor panel, and there, where it is connected to the end part, is made more rigid or thicker than there, where said recess is provided.

7. The set of floor panels of claim 4, wherein the bridge part comprises one or more of the following characteristics:

there, where the bridge part is connected to the core of the floor panel, it has a thickness which is at least ⅕ times an overall thickness of the floor panel; and/or there, where the bridge part is connected to the end part, it has a thickness which is at least ⅕ times the overall thickness of the floor panel.

8. The set of floor panels of claim 1, wherein the coupling parts are configured such that they allow uncoupling the floor panels, starting from the coupled condition, by means of a rotational movement of the one floor panel around the other floor panel, around an axis parallel to the installation plane and the edges, wherein during said rotational movement the upper sides of the floor panels are moved towards each other.

9. The set of floor panels of claim 1, wherein each of the floor panels comprises an edge adjacent to its aforementioned edge, herein below denominated adjacent edge, which is provided with a coupling part, wherein the coupling parts at the adjacent edges are configured such that they allow realizing a coupled condition between the floor panels, wherein the coupling parts at the adjacent edges, in the coupled condition, effect a locking in the direction parallel to the installation plane and perpendicular to the adjacent edges, as well as a locking in the direction perpendicular to the installation plane, and wherein the coupling parts at the adjacent edges are configured such that they, in the coupled condition, realize a tensioning force pressing the adjacent coupled edges towards each other, by means of an elastic bending of a lip pertaining to the coupling parts of the adjacent edges; and wherein, in the coupled condition of a plurality of the floor panels, an average degree of bending of the lip of the receiving hook, viewed over a length of the coupled edges, differs from the average degree of bending of the lip pertaining to the coupling parts of the adjacent edges, viewed over a length of the coupled adjacent edges.

10. The set of floor panels of claim 9, wherein the average degree of bending of the lip of the receiving hook is larger than the average degree of bending of the lip pertaining to the coupling parts of the adjacent edges.

11. The set of floor panels of claim 9, wherein the coupling parts at the adjacent edges are configured such that they allow realizing a coupled condition between the floor panels, by means of a rotational movement of the one floor panel in respect to the other floor panel, according to a direction parallel to the installation plane and the adjacent edges, in such a manner that a plurality of the floor panels can be coupled by means of a fold-down movement.

12. The set of floor panels of claim 9, wherein the coupling parts at the adjacent edges are realized as a tongue and a groove, wherein the groove is bordered by an upper lip and the aforementioned lip belonging to the coupling parts of the adjacent edges, herein below denominated lower lip;

wherein the lower lip extends beyond a distal extremity of the upper lip; and wherein the tongue and the groove are provided with lock-up parts, which in the coupled condition effect said locking in the direction parallel to the installation plane and perpendicular to the adjacent edges.

13. The set of floor panels of claim 1, wherein starting from a relaxed or initial condition, the movable part is arranged to perform a movement in a first direction towards the one floor panel during coupling and movement against the other floor panel, after the one floor panel and the other floor panel are coupled, the movable part is arranged to at least partially relax towards a locking condition and moves in a second direction towards the other floor panel.

14. A set of floor panels for forming a floor covering, which comprises at least two floor panels, which each comprise an upper side, a lower side, and a core extending between the upper and lower sides, and which each comprise an edge provided with a coupling part and the core extending from the edge to an opposite edge to said edge, wherein the coupling parts are configured such that they allow realizing a coupled condition between the floor panels by means of a substantially straight coupling movement of the one floor panel in respect to the other floor panel, according to a direction substantially perpendicular to an installation plane;

wherein the coupling parts in the coupled condition effect a locking in the direction parallel to the installation plane and perpendicular to said edges, as well as a locking in the direction perpendicular to the installation plane;

wherein the coupling part of the one floor panel is made as a hook-shaped part directed towards the lower side of the floor panel, herein below denominated locking hook, and the coupling part of the other floor panel is made as a hook-shaped part directed towards the upper side of the floor panel, herein below denominated receiving hook;

wherein the hook-shaped parts are manufactured from a material of the core of the floor panels and are made in one piece therewith;

wherein the locking hook comprises a lip which is provided with a locking part extending towards the lower side of the floor panel, and the receiving hook comprises a lip which is provided with a locking part extending towards the upper side of the floor panel;

wherein the locking parts, in the coupled condition, cooperate in such a manner that they effect at least the aforementioned locking in the direction parallel to the installation plane and perpendicular to said edges;

wherein the coupling parts are configured such that they, in the coupled condition, realize a tensioning force pressing the coupled edges towards each other, by means of an elastic bending of the lip of the receiving hook; and wherein the coupling parts are configured such that at least a portion of the locking part extending towards the lower side of the floor panel fits into an opening defined between the locking part extending towards the upper side of the floor panel and a proximal side of the receiving hook, without having to elastically bend the lip of the receiving hook for this purpose;

wherein a proximal end of the receiving hook defines a flat support surface generally parallel to the upper side of the floor panel and a distal end of the locking hook defines a flat surface generally corresponding to the flat surface of the receiving hook and adapted to engage flush therewith at a first contact zone;

wherein the locking parts of the receiving hook and the locking hook engage in an inclined configuration and only engage one another along a portion short of their entire respective lengths at a second contact zone;

wherein a gap is formed between the receiving hook and the locking hook between the first and second contact zones and extending into the core toward the lower side and below the support surface;

wherein the receiving hook defines an elasticity groove formed along a lower side of the lip of the receiving hook and has a proximal boundary edge extending vertically and perpendicular to the installation plane into the core toward the upper side, the elasticity groove extends generally horizontally in a distal direction from a proximal end of the lip such that while bending a distal tip at the distal end of the lip undergoes the maximum bending of the lip, said maximum bending is defined as bending of the distal tip of the lip relative to a maximum height of the proximal edge from the lower side of the panel, wherein in the coupled condition of the set of panels, the distal tip is arranged to be positioned below a plane of the lower side of the panels in the coupled condition, said bending of the lip occurring and pivoting at the proximal boundary edge and extending proximally toward the proximal end of the lip;

wherein the elastic bending of the lip of the receiving hook can be initiated by a mutual interaction of proximal sides, including locking surfaces of the locking parts, said elasticity groove underlying the locking surfaces, and extending distally and proximally horizontally beyond said locking surfaces.

15. The set of floor panels of claim 14, wherein the elastic bending of the lip of the receiving hook can be initiated from an already partially engaged condition of the hook-shaped parts.

16. A set of floor panels for forming a floor covering, which comprises at least two floor panels, which each comprise an upper side, a lower side, and a core extending between the upper and lower sides, and which each comprise an edge provided with a coupling part and the core extending from the edge to an opposite edge to said edge, wherein the coupling parts are configured such that they allow realizing a coupled condition between the floor panels by means of a substantially straight coupling movement of the one floor panel in respect to the other floor panel, according to a direction substantially perpendicular to an installation plane;

wherein the coupling parts in the coupled condition effect a locking in the direction parallel to the installation plane and perpendicular to said edges, as well as a locking in the direction perpendicular to the installation plane;

wherein the coupling part of the one floor panel is made as a hook-shaped part directed towards the lower side of the floor panel, herein below denominated locking hook, and the coupling part of the other floor panel is made as a hook-shaped part directed towards the upper side of the floor panel, herein below denominated receiving hook;

wherein the hook-shaped parts are manufactured from a material of the core of the floor panels and are made in one piece therewith;

wherein the locking hook comprises a lip which is provided with a locking part extending towards the lower side of the floor panel, and the receiving hook comprises a lip which is provided with a locking part extending towards the upper side of the floor panel;

wherein the locking parts, in the coupled condition, cooperate in such a manner that they effect at least the aforementioned locking in the direction parallel to the installation plane and perpendicular to said edges;

wherein the coupling parts are configured such that they, in the coupled condition, realize a tensioning force pressing the coupled edges towards each other, by means of an elastic bending of the lip of the receiving hook;

wherein the lip of the receiving hook has a minimum thickness, which is at least ⅕ times and at most ⅓ times an overall thickness of the floor panel; and wherein a length of the lip of the receiving hook, measured between a vertical closing surface and the distal end of the lip of the receiving hook, is at least 1 time and at most 3/2 times the overall thickness of the floor panel;

wherein a proximal end of the receiving hook defines a flat support surface generally parallel to the upper side of the floor panel and a distal end of the locking hook defines a flat surface generally corresponding to the support surface of the receiving hook and adapted to engage flush therewith at a first contact zone;

wherein the locking parts of the receiving hook and the locking hook engage in an inclined configuration and only engage one another along a portion short of their entire respective lengths at a second contact zone;

wherein a gap is formed between the receiving hook and the locking hook between the first and second contact zones and extending into the core toward the lower side and below the support surface;

wherein the receiving hook defines an elasticity groove formed along a lower side of the lip of the receiving hook and has a proximal boundary edge extending vertically and perpendicular to the installation plane into the core toward the upper side, the elasticity groove extends generally horizontally in a distal direction from a proximal end of the lip such that while bending a distal tip at the distal end of the lip undergoes the maximum bending of the lip, said maximum bending is defined as bending of the distal tip of the lip relative to a maximum height of the proximal edge from the lower side of the panel, wherein in the coupled condition of the set of panels, the distal tip is arranged to be positioned below a plane of the lower side of the panels in the coupled condition, said bending of the lip occurring and pivoting at the proximal boundary edge and extending proximally toward the proximal end of the lip;

wherein the elastic bending of the lip of the receiving hook can be initiated by a mutual interaction of proximal sides, including locking surfaces of the locking parts, said elasticity groove underlying the locking surfaces, and extending distally and proximally horizontally beyond said locking surfaces.

17. The set of floor panels of claim 16, wherein said minimum thickness is at most 0.3 times the overall thickness of the floor panel.

18. The set of floor panels of claim 16, wherein said length is at most 1.4 times the overall thickness of the floor panel.

* * * * *